United States Patent [19]

Hogendobler et al.

[11] 4,070,751

[45] Jan. 31, 1978

[54] METHOD OF MAKING A COAXIAL CONNECTOR

[75] Inventors: Richard Shure Hogendobler, Camp Hill; Robert Maclay Murray, Elizabethtown, both of Pa.

[73] Assignee: AMP Incorporated, Harrisburg, Pa.

[21] Appl. No.: 758,731

[22] Filed: Jan. 12, 1977

[51] Int. Cl.[2] ..... H01R 43/04

[52] U.S. Cl. ..... 29/628; 29/418; 29/629; 29/630 A; 113/119; 339/177 R; 339/276 SF

[58] Field of Search ..... 29/628, 629, 630, 418; 113/119; 339/177 R, 177 E, 276 SF

[56] References Cited

U.S. PATENT DOCUMENTS

| | | | |
|---|---|---|---|
| 3,455,022 | 7/1969 | Schmitz, Jr. | 339/276 SF |
| 3,828,305 | 6/1974 | Hogendobler | 339/177 R |
| 3,913,195 | 10/1975 | Beaver | 29/418 X |

*Primary Examiner*—Carl E. Hall
*Attorney, Agent, or Firm*—Gerald K. Kita

[57] ABSTRACT

The disclosure relates to an assembly of stamped and formed parts for a coaxial connector with RF shielding ensured by a unitary ferrule intimately surrounding open seams in the stamped and formed parts. Also the disclosure relates to a blank which may be formed into a coaxial connector part having large diametrical transitions which ordinarily introduce RF attenuation but for the intimately surrounding unitary ferrule.

2 Claims, 5 Drawing Figures

METHOD OF MAKING A COAXIAL CONNECTOR

BACKGROUND OF THE PRIOR ART

A typical coaxial connector of the prior art is disclosed in U.S. Pat. No. 3,297,979, and is typified by a number of sleeve form component parts assembled concentrically over one another. The component parts are fabricated by drawing, thereby eliminating seams and other discontinuities which allow signal leakage and voids in electrical shielding. Drawn parts are high in cost and are not capable of fabrication collectively along a carrier strip. Consequently each drawn part must be handled individually for assembly, contributing further to high costs.

BRIEF DESCRIPTION

A major contribution of the present invention is embodied in replacing drawn parts of a connector with stamped and formed parts suitable for automatic machine assembly. Hand assembly heretofore required by drawn parts is thereby eliminated. Drawn parts are advantageous because they are free of seams through which signal and noise leakage can occur. Stamped and formed parts have such seams and have been considered therefore as unsuitable. Further seams weaken stamped and formed parts. During crimping the seams would open up and allow undesirable deformation of the parts. Often the presence of a seam under a crimping die would cause undesirable distribution of the crimp indentation. The present invention solves these drawbacks and problems associated with stamped and formed parts. Advantageously a ferrule of unitary seamless construction intimately surrounds the one or more seams in the stamped and formed parts closing off potential RF leakage paths. The seams are also strengthened by virtue of their being overlaid by the seamless ferrule. The seams need not be perfectly of hairline width but may have large width openings which ordinarily would be unaesthetic, structurally unsound and unsuitable for RF or electrically shielded signal transmission. By eliminating the need for perfectly formed seams, rejection of imperfectly formed parts is reduced and the high costs for manufacturing parts to inordinately controlled close tolerances is eliminated.

Large diametrical changes required in a single sleeve form metal part have proved difficult to fabricate by stamping and forming. This is particularly true if the component part includes a tapered or frusto-conical section or transition between and joining a small diameter section and a large diameter section. The transition must be formed from a blank having a development including a plurality of relieved areas which show up in the formed transition as open seams or slits. There has been a long standing reluctance to manufacture such parts with slits, because the slits are structurally unsound and are difficult to keep in hairline width because the metal is inherently resilient and has a tendency thereby to spring apart at the seams or slits. The present invention allows a coaxial connector to be made despite the defects inherent in stamped and formed parts, and without a need to eliminate the defects.

OBJECTS

An object of the present invention is to provide a coaxial connector fabricated from a stamped and formed part which contains slits that ordinarily would be detrimental to either the mechanical or electrical operation of a coaxial connector.

Another object of the present invention is to provide a coaxial connector incorporating a stamped and formed part having one or more slits which are overlaid by a seamless ferrule to eliminate the unsound structural and leakage path defects inherent in the slits.

Another object of the present invention is to provide a method for manufacturing a coaxial connector body stamped and formed from a blank having a development characterized by a smaller diameter sleeve form development and a large diameter sleeve form development integrally joined by a transition having a frusto-conical sleeve form development, which blank when formed into a connector body includes a longitudinal seam and at least one additional slit in said frusto-conical transition.

Other objects and many attendant advantages of the present invention will become apparent upon perusal of the following detailed description taken in conjunction with the drawings.

DETAILED DESCRIPTION

Figure 3:
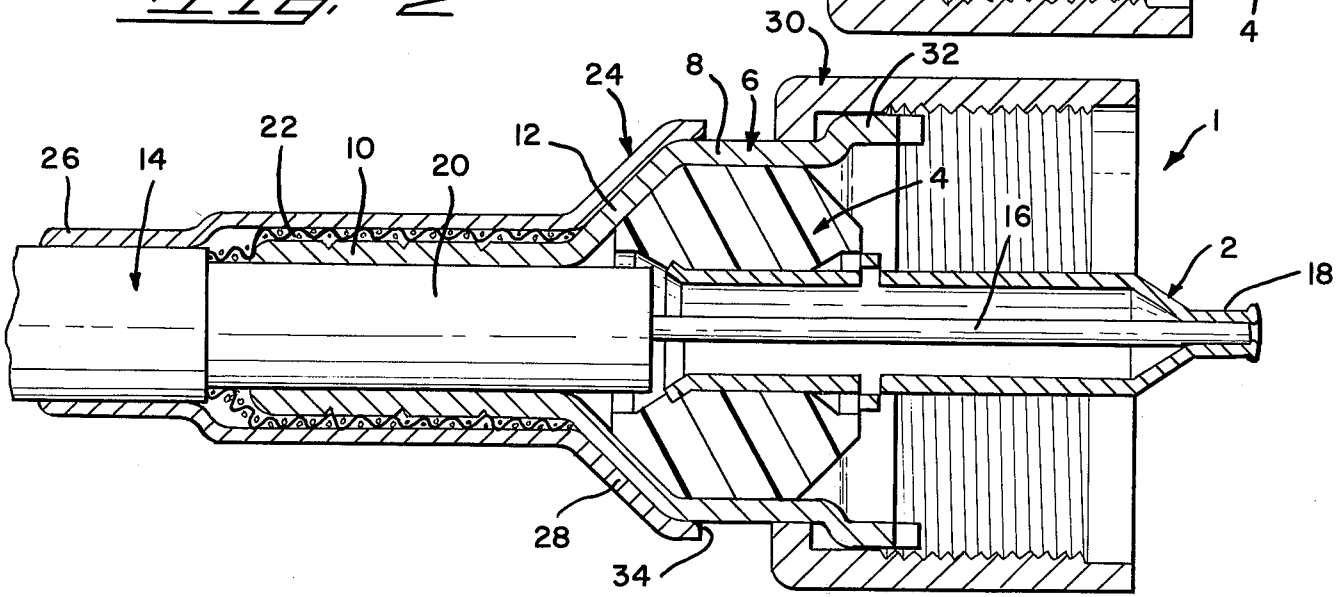
FIG. 3 is an enlarged section of the component parts of FIG. 2 assembled onto a coaxial cable with the carrier strip removed to provide a coaxial connection.

With more particular reference to the drawings, FIG. 3 illustrates a coaxial connector indicated generally at 1 having a reduced diameter center contact 2, generally of sleeve form, an encircling dielectric body 4, and an outer enlarged sleeve form connector body 6. The connector body has an enlarged diameter section or portion 8, a smaller diameter section or portion 10 and an intermediate frusto-conical or tapered diameter portion 12 which forms an integral transition joined between the sections 8 and 10. A coaxial cable generally indicated at 14 has a center conductor 16 extending within the hollow interior of the center contact 2 and radially crimped for electrical connection within a reduced diameter tip 18 of the center contact 2. A dielectric sheath 20 encircling the center conductor 16 is freely inserted and disposed within the smaller diameter section 10. A conductive sheath 22 over the sheath 20 is assembled over the section 10 of the connector body. A seamless unitary metal ferrule 24 is assembled concentrically over the sheath 22, the section 10 and the sheath 20 and is radially crimped to provide a mechanical and electrical connection between the mutually engaged concentric metal parts. A rearward section 26 of the ferrule 24 is radially crimped to grip the cable 14 and provide a strain relief. A forward portion of the ferrule is frusto-conical or tapered in shape as shown at 28. This portion of the ferrule intimately engages and encircles the transition 12 completely covering the same and the aesthetic and electrical defects thereof, which will be described. Further any structural weaknesses inherent in the transition will be overlaid by the ferrule portion 28 and will be compensated for or strengthened thereby. To complete the connection, an internally threaded coupling ring 30 is freely rotatably received over the section 8 of the connector body 6. In some connections the ring 30 is not necessary. The ring therefore is optional, but if provided, it is captivated for limited axial movement over the section 8. More specifically, an integral diametrically outwardly projecting lip 32 of the section 8 and the forward edge 34 of the ferrule which extends from the tapered portion 28 to overlie the section 8 define a space therebetween in which the ring is captivated.

Figure 1:
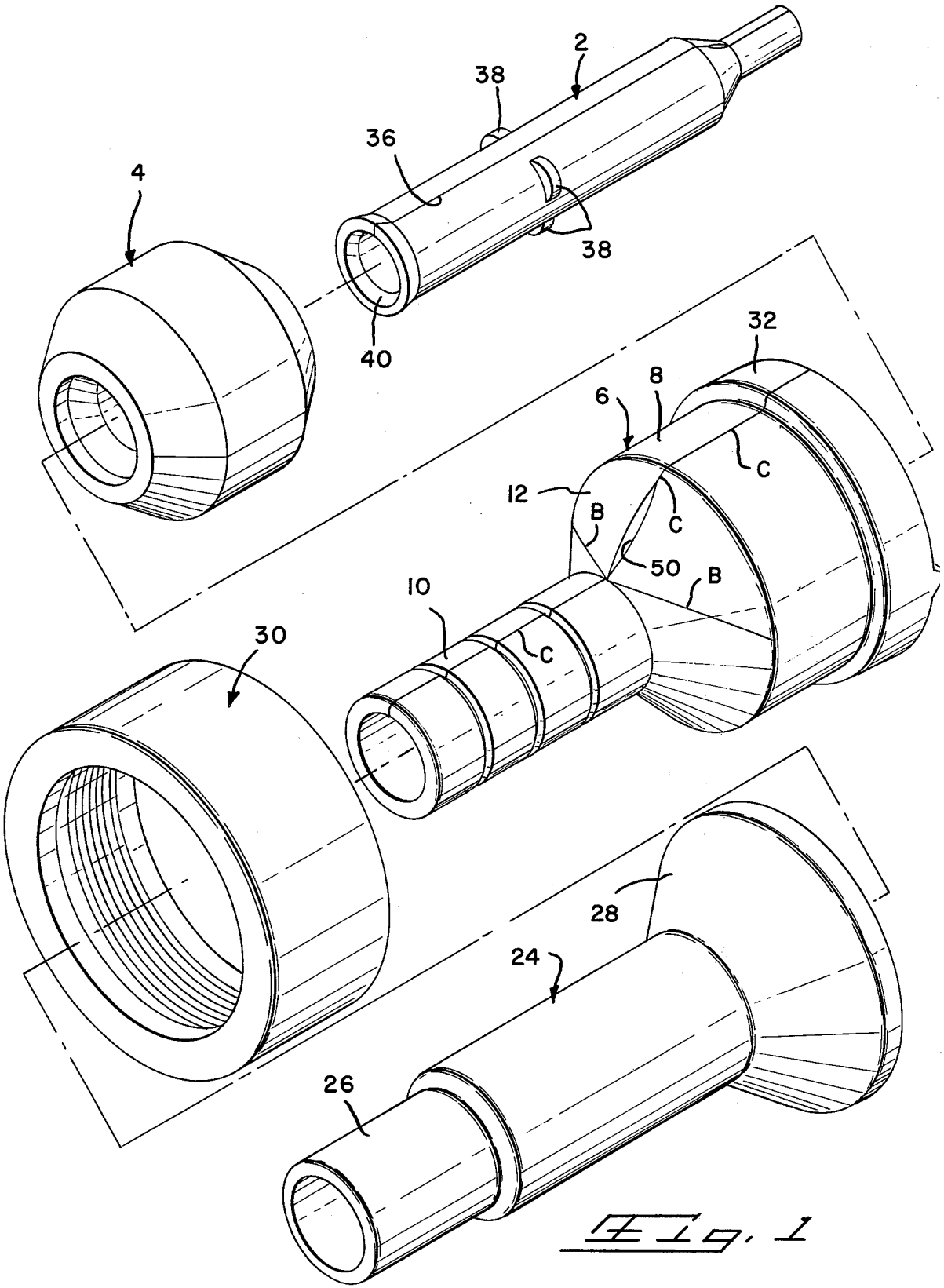
FIG. 1 is an enlarged perspective illustrating component parts of a coaxial connector according to the present invention is exploded configuration.
Figure 5:
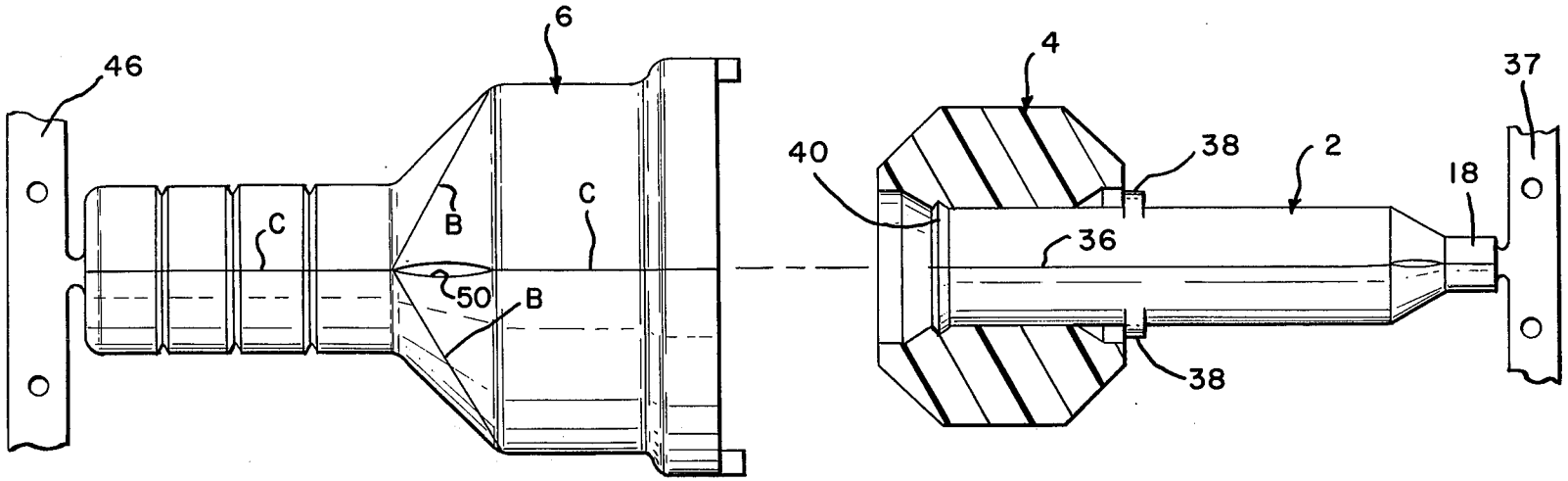
FIG. 5 is a diagrammatic plan view illustrating a series of assembly steps in manufacturing a coaxial connector and in making the coaxial connection of FIG. 3.

As shown more particularly in FIGS. 1 and 5, the center contact 2 is stamped out from a strip of metal and formed into a sleeve form having a longitudinal seam 36. In practice a series of contacts 2 are joined by the tips 18 serially along an integral carrier strip 37. The contact includes a plurality of loops 38 radially struck out to project from the periphery of the sleeve form to provide a radially projecting plurality of stops for locating the dielectric body in position thereon. More particularly, FIG. 5 illustrates one of the series of contacts 2 joined at the tip 18 to the carrier strip 37. An opposite end of the contact is outwardly diametrically flared as shown at 40. A corresponding dielectric body 4 is assembled concentrically over the contact 2 and is captivated between the loops 38 and the flared end 40. The carrier strip 37 may be used as a mechanical expedient to serially feed the series of center contacts 2 serially to a first assembly station where dielectric inserts 4 are assembled over the contacts 2. The flared ends 40 optionally may be provided during stamping and forming the contacts 2, in which case the inserts 4 must be axially forced over the flared ends. Alternatively the inserts 4 may be assembled over the contacts 2 and subsequently the flared ends 40 may be provided by applying a flaring tool of any well known type in registration against the ends 40 and flaring the same by reaming action. Such flaring operation may be accomplished either at the first assembly station or at a following assembly station to which the assembled contacts 2 and dielectric bodies are conveyed by indexing the carrier strip. At another following assembly station corresponding connector bodies 6 are assembled over dielectric bodies 4 to provide a series of coaxial or concentric subassemblies 44 of center contacts 2, dielectric bodies 4 and connector bodies 6. In practice the connector bodies 6 are stamped and formed in a series along an integral carrier strip 46. The subassemblies 44 may then advantageously have a pair of parallel carrier strips 37 and 44 which may be used to align and convey the subassemblies 44 to one or more additional assembly stations. Also the carrier strips 37 and 44 may be used to reel up the subassemblies for packaged storage and transport to a remote location where they can be stored until assembly onto coaxial cables.

Figure 2:
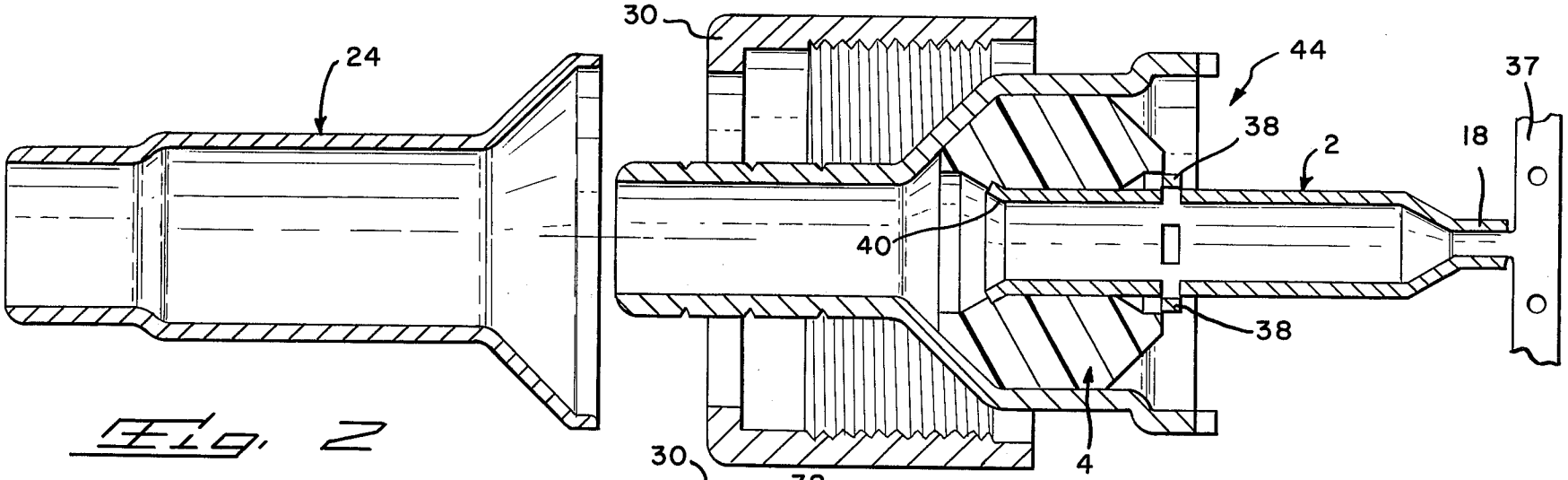
FIG. 2 is an enlarged section of the component parts in FIG. 1 with certain stamped and formed component parts together in a subassembly attached to a carrier strip.

FIG. 2 illustrates a typical subassembly 44 yet attached to at least one of the carrier strips 37 (the other carrier strip 46 being separated and discarded) by which the subassembly 44 is indexed or conveyed to one or more additional assembly stations where the optional ring 30, the cable 14 and the ferrule 24 may be assembled. Upon separation from the carrier strip 37, a completed coaxial connection is provided, as shown in detail in FIG. 3.

Figure 4:
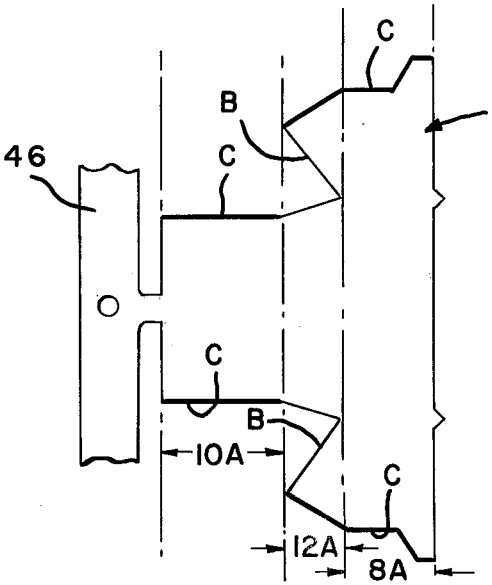
FIG. 4 is an enlarged plan view of a repeatable blank development for a connector body which is one of the component parts illustrated in each of the previous figures.

FIG. 4 illustrates a repeatable stamped out blank 48, for each connector body, which is attached integrally to the carrier strip 46. The blank has a reduced or smaller diameter sleeve form development 10A, which may be flared into the smaller section 10, a larger diameter sleeve form development 8A, which may be formed into the sleeve from section 8, and an interposed frustoconical sleeve form development 12A, which may be formed into the transition 12 of the connector body 6. More particularly the development 12A is integral with and interposed between the developments 8A and 10A. Relieved notch portions B are provided in the development 12A. Also a discontinuous longitudinal seam indicated by the broad or heavy object lines C runs transversely through the developments and spans the entire length of the blank 48. When the blank is forced into the connector body 6 shown in FIGS. 1 and 5, the seam C will appear continuous and running the entire length axially of the connector body 6. The relieved portions B will form corresponding slits B in the transition of connector body 6. As illustrated, two slits B are necessitated by the development 12A. However, if the development 12A were of a shape different than that shown only one relieved portion B is foreseeably necessitated, for example if the transition 12 were less severely tapered. Also if more severely tapered, the transition development might require more than two relieved portions B.

Ordinarily the presence of the seam C and the slits B would be unsatisfactory, making a stamped and formed coaxial connector body unusable. The seam C and also each slit B would provide electrical leakage paths for signal and interference phenomena. Also they structurally weaken the connector body. They are unaesthetic. They are difficult to minimize to hairline widths, as evidenced by the presence of a relatively large gap defect 50. Such gap defects ordinarily would magnify the above-mentioned factors rendering the connector body unsuitable. Eliminating such defects by closely controlling tolerances would be expensive and would require discarding large numbers of imperfectly formed connector bodies. The present invention however was devised to permit such defects in the coaxial connector without suffering the disadvantages of the defects. More particularly, when the ferrule 24 is assembled over the connector body a substantial length of the seam C is covered by the ferrule. Also the slits B are completely covered by the ferrule. The ferrule portion 28 intimately engages the transition 12 and spans across the slits B and a corresponding portion of the seam C which runs through the transistion. The weakened transition is thereby strengthened by being stopped against the seamless ferrule, and all leakage paths provided by the gap 50 and the widths of both the seam C and slits B are covered eliminating signal attenuation and shielding leakage. Crimping on the connector body is restricted to the smaller diameter section which is concentrically overlaid by the ferrule. Ordinarily the crimping pressure across the seam C might cause the seam to open up; another mode for rendering a stamped and formed part unsatisfactory for a coaxial connection. However, the crimp location is restricted to that portion of the connector body seam which is completely overlaid concentrically by the ferrule, eliminating the tendency for the seam to shift or open up under crimping pressure. That portion of the seam C which is exposed, not covered by the ferrule is free of crimping pressure and is not subject to crimping damage.

Although a preferred embodiment has been illustrated and described, other embodiments and modifications which would be apparent to one having ordinary skill in the art are intended to be covered by the spirit and scope of the appended claims.

What is claimed is:

1. A method for manufacturing a coaxial connector, comprising the steps of:

separately forming a series of center contacts along a first carrier strip and a series of connector bodies along a second carrier strip each of said connector bodies having at least one slit and a longitudinal seam, assembling said series of center contacts together with corresponding dielectric slugs encircling said center contacts concentrically within said series of connector bodies to form a series of subassemblies, retaining said series of subassemblies along at least one of said carrier strips, conveying said series of subassemblies together with said at least one of said carrier strips to an assembly station where at each said subassembly is assembled to a coaxial cable and is separated from said at least one of said carrier strips, and covering said at least one slit and said longitudinal seam of each connector body with a seamless ferrule.

2. A method according to claim 1, and further including the step of:

stamping out from metal strip a blank for each of said connector bodies wherein a smaller diameter cylinder development is integrally connected to a larger diameter cylinder development by an interposed and integral transition section having a frusto-conical sleeve form development, and wherein said step of forming a series of connector bodies further includes the step of: forming each of said blanks into a sleeve form connector body characterized by a longitudinal seam and at least one slit in said transition section in addition to said longitudinal slit.

* * * * *